United States Patent [19]

Petrich

[11] 4,106,539

[45] Aug. 15, 1978

[54] FOLDING HATCHET

[76] Inventor: Walter R. Petrich, 621 N. Yale, Fullerton, Calif. 92631

[21] Appl. No.: 788,316

[22] Filed: Apr. 18, 1977

Related U.S. Application Data

[63] Continuation-in-part of Ser. No. 714,611, Aug. 16, 1976, abandoned.

[51] Int. Cl.[2] ..... B26B 23/00

[52] U.S. Cl. ..... 145/2 A

[58] Field of Search ..... 145/2 A, 2 R, 3, 29 R, 145/61 G

[56] References Cited

U.S. PATENT DOCUMENTS

| | | | |
|---|---|---|---|
| 1,245,394 | 11/1917 | Smith et al. | 145/3 |
| 1,795,227 | 3/1931 | Miller et al. | 145/2 A |
| 1,895,342 | 1/1933 | Pelton et al. | 145/2 R |
| 2,377,730 | 6/1945 | Vosbikian et al. | 145/2 R |
| 2,793,664 | 5/1957 | Warrington | 145/2 R |
| 2,989,100 | 6/1961 | Burdis et al. | 145/2 A |

FOREIGN PATENT DOCUMENTS

| | | | |
|---|---|---|---|
| 131,311 | 4/1951 | Sweden | 145/29 R |

*Primary Examiner*—James L. Jones, Jr.
*Assistant Examiner*—Joe Zatarga
*Attorney, Agent, or Firm*—Raymond L. Madsen

[57] ABSTRACT

There is disclosed a folding hand tool comprising a channel member having a head member rotatably attached to one end and a handle device rotatably attached to the other end with a block member attached to the channel member oppositely disposed the head member, the head member being locked in an operating position to the block member by a bolt member passing through the block member and having a hook on one end thereof which engages a receptacle in the head member and is secured therein by tightening a nut member threadably engaged on the other end of the bolt member to hold the head member in a fixed position with respect to the channel member. Alternatively, the head member is locked to the block member by a sliding pin located in a receptacle in the head member and biased to engage a hole in the block member when the head member is rotated into its operating position.

7 Claims, 6 Drawing Figures

FOLDING HATCHET

This is a continuation-in-part of Ser. No. 714,611, filed Aug. 16, 1976 now abandoned.

This invention relates to a collapsible hand tool and more particularly to a portable hand tool which may be folded to occupy a very small space.

In the field of folding hand tools, it has been the general practice to employ detents of leaf springs as described in U.S. Pat. No. 2,989,100 granted to W. Burdis, et al. to engage a retaining pin on the head of the folding tool for cooperative retaining engagement of the head in an operating position. Although such elements have served the purpose, they have not proved entirely satisfactory under all conditions of service for the reasons that considerable difficulty has been experienced in preventing the retaining pin on the head from becoming disengaged from the leaf spring or detent when force is applied to the hand tool.

Those concerned with the development of folding hand tools have long recognized the need for a mechanism which firmly locks the head member of the hand tool into place to withstand the operative forces applied thereto. The present invention fulfills this need.

The general purpose of this invention is to provide a collapsible or folding hand tool which embraces all the advantages of simply employed coollapsible tools and possess none of the aforedescribed disadvantages. To obtain this, the present invention contemplates a unique head arrangement attached to a channel shaper holder whereby undesired pivoting and rotation during operative application of the head member of the tool are avoided.

It is an object of the present invention to provide a folding or collapsible hand tool which includes a channel shaped holder having a pivotally mounted head member therein adjacent one end thereof and having a block member oppositely disposed therefrom with a bolt or pin which engages both the head and block members whereby the head member may be securely locked into an operating position with respect to the channel shaped holder to prevent undesired and inadvertent rotation of the head member in the channel member during operative application of the tool.

It is a further object of the present invention to provide a form of collapsible hand tool construction wherein the head member is pivotally mounted with the holder and is fixedly secured therein during operative application against accidental rotation relative to the holder, and wherein a handle is normally in alignment with the holder and includes means for fixedly retaining the aligned relation when in use.

A still further object of the present invention is to provide an adjustable clamping mechanism upon the channel shaped holder of a collapsible hand tool, adapted for cooperation with the head member of the hand tool when the hand tool is in use, but which is easily released to disengage the head member to permit folding and collapsing of the head member into the channel of the channel-shaped holder.

Yet another object of the present invention is to provide a folding hand tool with a rotating tool member containing a locking pin which engages a block member attached to the handle when the tool member is rotated into its operating position.

Other objects and many of the intended advantages of this invention will be readily appreciated as the same becomes better understood by reference to the following detailed description when considered in connection with the accompanying drawings in which like reference numerals designate like parts throughout the figures thereof and wherein FIG. 1 is a perspective view of a preferred embodiment of the invention;

Figure 1:
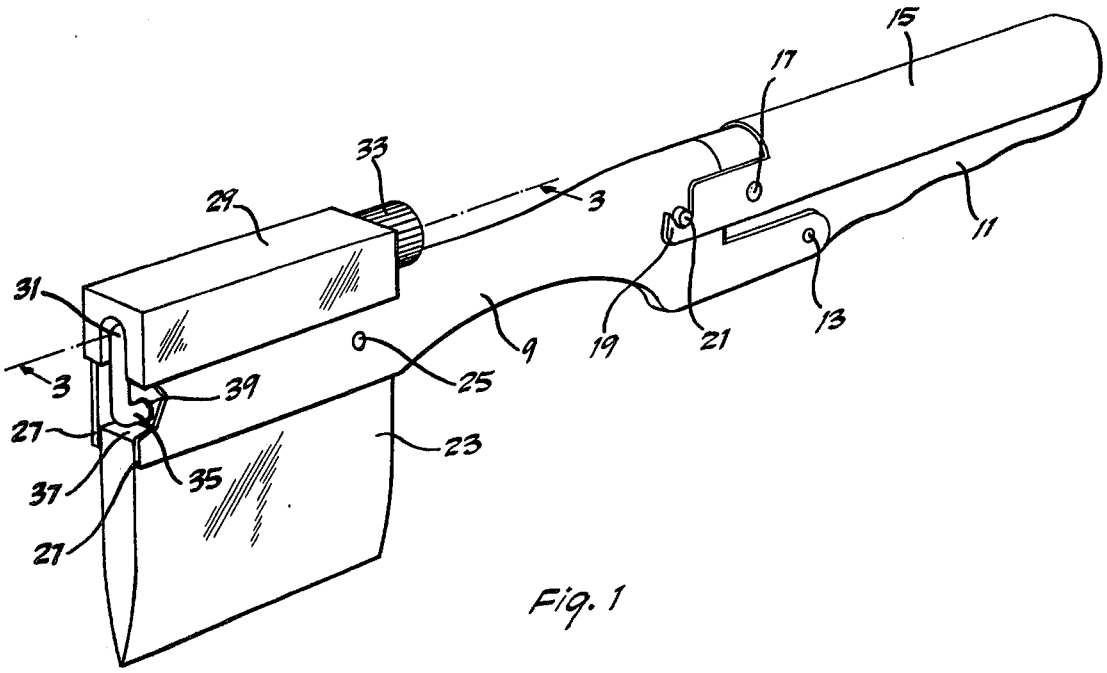

Referring now to the drawings, wherein like reference characters designate like or corresponding parts throughout the several views, there is shown in FIG. 1 (which illustrates a preferred embodiment) a channel member or base member 9 to which is rotatably attached a handle member 11 by a shaft 13. A latch member 15 is rotatably attached to handle member 11 by a pin 17, latch member 15 having a slot or hook 19 which engages a projection 21 on channel member 9 to lock and fixedly locate handle member 11 in an extended position from channel member 9. A head member or hatchet blade 23 is rotatably attached to channel member 9 by a pin 25. Head member 23 rotatably slides between sides 27 of channel member 9. Oppositely disposed from head member 23 and attached to channel member 9 is a block or support member 29 having an elongated hole or opening therethrough through which a hook-shaped or latch bolt 31 passes and is secured therein by a nut 33 threadably engaged to one end thereof, the hook end 35 of bolt 31 being located in a recess 37 in head member 23 and engaging a receptacle 39 located therein.

Figure 2:
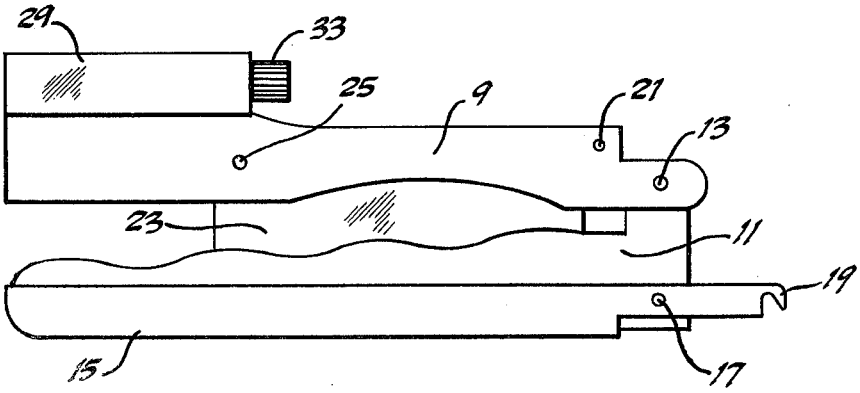
FIG. 2 illustrates a side elevation of the apparatus shown in FIG. 1 in a folded or collapsed position.

Turning now to FIG. 2, there is illustrated the collapsible hand tool of FIG. 1 positioned in the folded condition. Handle member 11 has a channel therein which engages one side of head member 23, latch member 15 being rotatably positioned adjacent handle member 11. Channel member 9 engages the other side of the head member 23 such that channel member 9 and handle member 11 are oppositely disposed along and enclosing the edges of head member 23.

Figure 3:
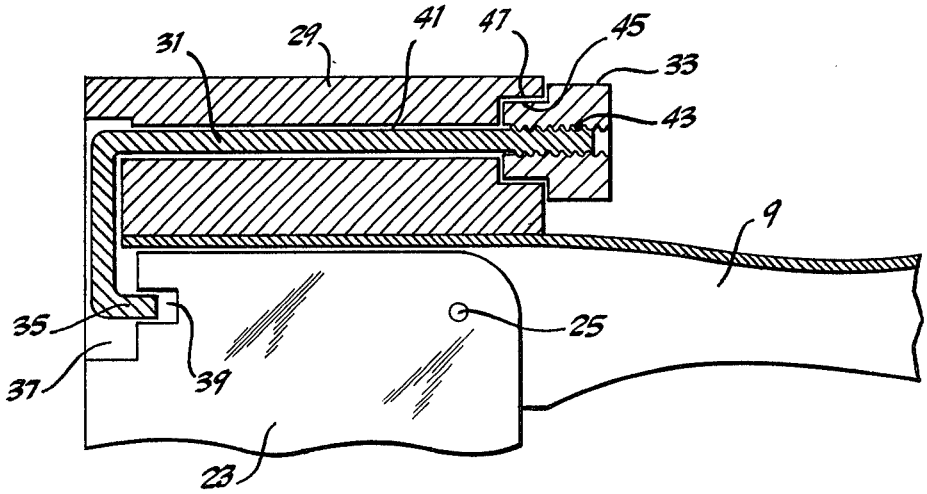
FIG. 3 illustrates a section of the device, partly cut away, taken on the line 3—3 of FIG. 1 looking in the direction of the arrows.

FIG. 3 illustrates a cross section of the device taken on line 3—3 of FIG. 1 looking in the direction of the arrows, and shows head member 23 rotated about pin 25 into operating position and locked therein by hooked end 35 of bolt 31 engaging receptacle 39 in recess 37. Bolt 31 passes through an elongated opening 41 in block member 29 and has an elongated threaded end 43 thereon threadably engaging nut 33 which has a shoulder or neck 45 thereon received into a receptacle or void 47 of block member 29.

Figure 4:
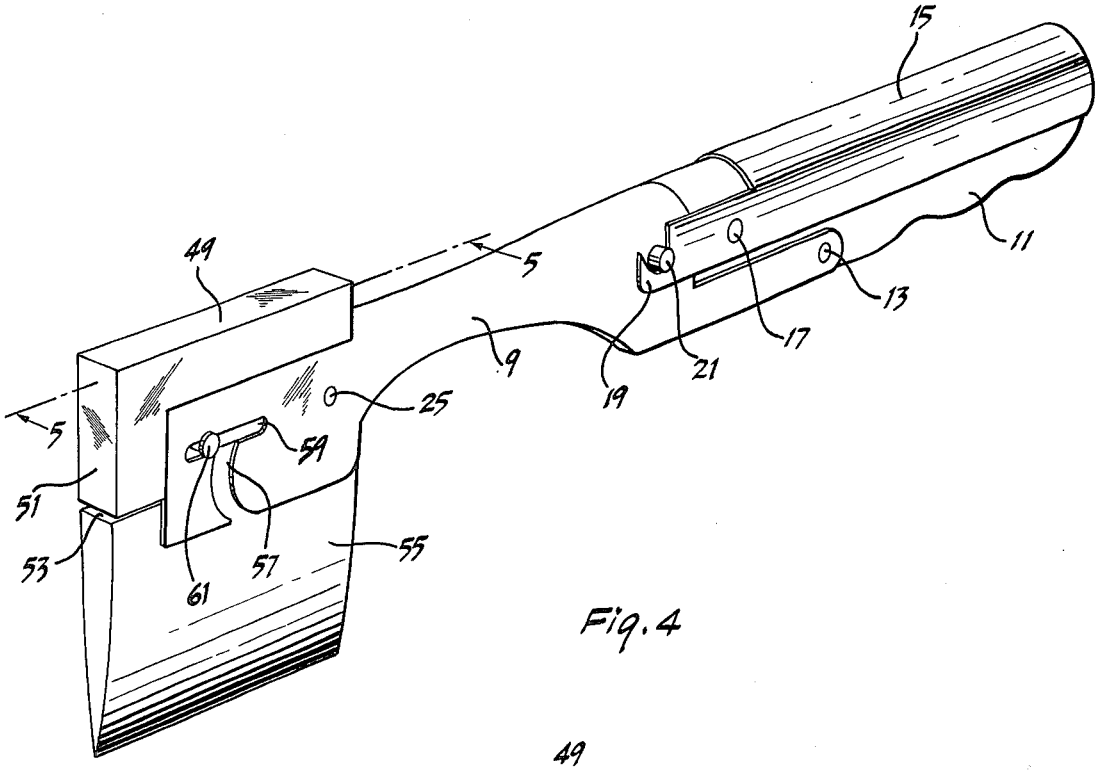
FIG. 4 is a perspective view of an alternate embodiment of the invention.
Figure 5:
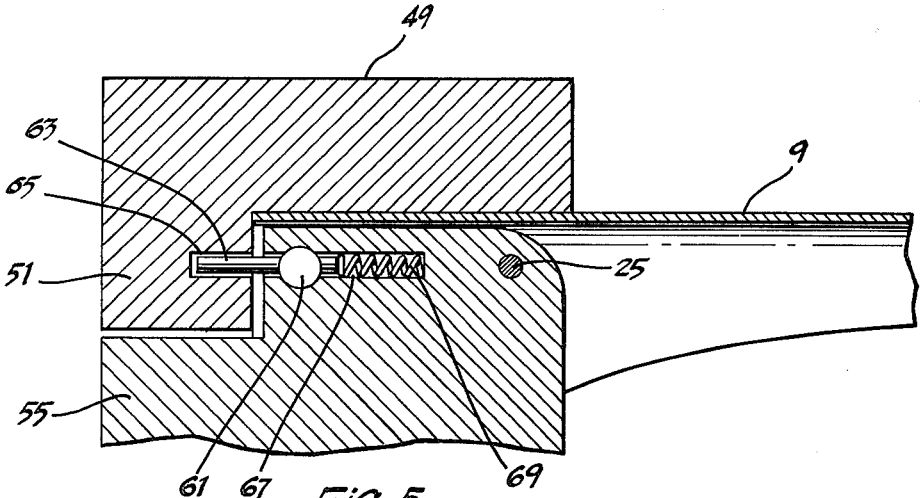
FIG. 5 shows a cross-section partly cut away, taken on line 5—5 of FIG. 4 looking in the direction of the arrows.

FIG. 4 shows an alternate locking mechanism embodying an "L" shaped block member 49 having a toe 51 which mates with a notch or cut-out 53 in a rotatable head or tool member 55. Channel member 9 has a slot 57 which terminates in a cross-slot 59 which slots are engaged by an extension arm 61 of a pin (not visible) slideably mounted on head 55 to engage a hole (not visible) in toe 51;

FIG. 5 shows a cut-away portion in section taken along line 5—5 of the folding tool of FIG. 4 in the direction of the arrows showing a pin or bolt 63 slideably mounted in a receptacle 67 in tool member 55 and biased by a spring member 67 to extend therefrom into a hole 65 in toe 51 of block member 49.

Figure 6:
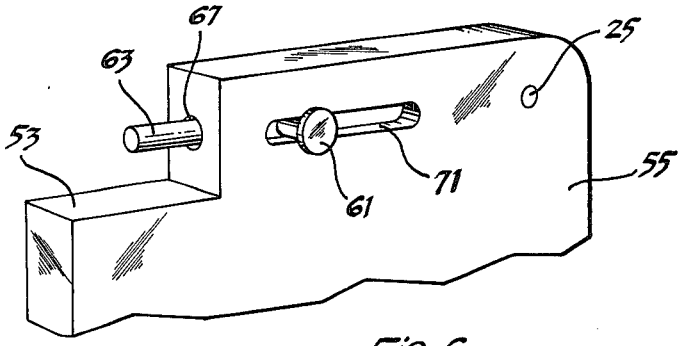
FIG. 6 illustrates a perspective view of the head member, partly cut away.

FIG. 6, a cut-away portion of head 55 is shown removed from channel member 9 with pin 63 extending from receptacle 67 into notch 53. Extension arm 61 extends through a slot 71 in head member 55, slot 71 opening into receptacle 67.

Operation of the invention can best be described by reference to FIG. 3 wherein head member 23 is rotated into operating position. The hooked end of hook or latch bolt 31 is engaged into receptacle 39 located in recess 37 of head member 23. The hooked or "C" shaped end 35 of bolt 31 fits or nests and is protected within recess 37 so as not to protrude or extend beyond the edge of head member 23. Bolt 31 is secured in block member 29 by a nut 33 being tightened along threads 43 until the neck portion 45 thereof is tightly engaged in receptacle or void 47 in block member 29. Thus, hook end 35 of latch bolt 31 is securely engaged in receptacle 39 to firmly lock and hold head member 23 in an operative position. If head member 23 is the blade of a folding hatchet, as illustrated in the drawings, and the blade is used to chop and cut wood, it is firmly and rigidly held in operating position even though the blade may be jammed or driven solidly into the wood and extreme force is used to remove it therefrom. Therefore, the problems of disengagement of a spring or detent type clamping mechanism from the hatchet head are overcome. In addition, the present invention provides a flat surface on block 29 which can be used as a hammer surface for hammering in stakes for tents and the like. It should be noted that neck 45 on nut 33 is securely engaged within receptacle 47 of block 29 such that when nut 33 is inadvertently struck while using block 29 as a hammering surface, threaded end 43 of bolt 31 is not bent or sheared.

Although hook 19 is illustrated in FIG. 1 and FIG. 2 for clamping latch member 15 and handle member 11 to channel member 9, a sliding latch member may be utilized whereby longitudinal slots in latch member 15 engage projections 21 on channel member 9 and pins 17 slide along similar longitudinal slots in the latch member.

Turning to FIGS. 4, 5 and 6, the locking mechanism comprises pin or bolt 63 slideably mounted in head 55 and biased to engage hole 65 in toe 51 of block 49. As head 55 is rotated from a folded position, illustrates in FIG. 2, into an operating position, illustrated in FIG. 5, extension arm 61 engages slot 57 which is shaped to force pin 63 against bias spring 69 into receptacle 67 such that it does not contact toe 51. When head 55 is located in its operating position, extension arm 61 is positioned in cross-slot 59, thereby releasing pin 63 to slide from receptacle 67 into hole 65 in toe 51 in response to the bias of pin 69, locking head 55 in its operating position.

Therefore, it should be readily observable that the present invention provides a positive acting and rigid clamping mechanism to secure the folding head of a collapsible hand tool in operative position along with a block member which may be used as a hammer and includes a latch bolt and a nut member which is recessed in the block member to protect it from damage during hammering.

It now should be apparent that the present invention provides a mechanical clamping arrangement which may be employed in conjunction with a folding or collapsible hand tool for firmly fixing and securing the folding head member of the hand tool may occur during use, while providing a block surface which may be used as a hammer.

Although particular components, etc., have been discussed in connection with a specific embodiment of a folding hand tool constructed in accordance with the teachings of the present invention, others may be utilized. Furthermore, it will be understood that although an exemplary embodiment of the present invention has been disclosed and discussed, other applications and mechanical arrangements are possible and that the embodiments disclosed may be subjected to various changes, modifications, and substitutions without necessarily departing from the spirit of the invention.

What is claimed is:

1. In a folding hand tool wherein a tool member is rotatably attached to a channel handle member, the improvement comprising:

a tool member having a working position and a folded position, said tool member having a receptacle therein adapted to receive a pin in sliding engagement therewith, said tool member having a slot therein which opens into said receptacle;

rigid block means attached to the channel member and having a hole thereon adapted to receive and engage a pin;

a pin slideably mounted in said receptacle of said tool member, said pin engaging said hole of said block means when said tool member is rotated into said working position thereby locking said tool member in a fixed position with respect to the channel handle member, said pin disengaging said hole of said block means thereby unlocking said tool member from said block means for rotating said tool member into said folded position; and a manual extension arm attached to said pin and extending through said slot in said tool member, said manual extension arm being movably positioned in said slot to move said pin into engagement and disengagement with said hole in said block means.

2. The improvement described in claim 1 further including bias means connected between said pin and said tool member to bias said pin into engagement with said block means.

3. The improvement described in claim 2 further including:

an extension arm mounted on said pin at right angles thereto and extending from said receptacle in said tool member, said extension arm being adapted to engage a slot in a channel handle member; and a channel handle member having a slot therein located in a position to engage said extension arm of said pin as said tool member is rotated from said folded position to said working position, said slot having a shape which gradually forces said extension arm and said pin against said bias means to position said pin out of contact with said block means, said slot having a shape which releases said extension arm and said pin to engage said hole of said block means when said tool member is in said working position.

4. A folding hatchet comprising:

a channel member having a channel therealong and having two ends, one end being adapted to rotatably receive within said channel the blunt end of a hatchet blade and the other end being adapted to connect to a handle;

a hatchet blade having two oppositely disposed faces and a blunt end oppositely disposed from a cutting edge, said blunt end have a corner rotatably attached to said one end of said channel member such that said hatchet blade may be rotated into a folded position into said channel of said channel member and may be rotated into a working position with said blunt end located in said channel of said channel member, said hatchet blade having an elongated hole therein parallel to and centrally located between said oppositely disposed faces adjacent said blunt end and having an elongated slot on one of said faces which slots has two ends and is aligned with said elongated hole and connects a portion of said elongated hole with said one of said faces;

a sliding bolt mounted in said elongated hole in said hatchet blade and having a manual extension arm connected thereto which extends through said slot in said hatchet blade and outward from said one of said faces, said sliding bolt being slideable in said elongated hole and said manual extension arm being slideable in said slot such that when said manual extension arm is substantially at one end of said slot, said bolt is contained fully within said elongated hole and when said manual extension arm is substantially at the other end of said slot, said bolt extends from said elongated hole;

bias means connected between said bolt and said hatchet blade for biasing said bolt into a projecting position, said manual extension arm operable to move said bolt against said bias means ;

a block member attached to said channel member, said block member having a receptacle therein positioned opposite said elongated hole in said hatchet blade when said hatchet blade is rotated into said working position whereby said bolt is biased to engage said receptacle and lock said hatchet blade in said working position; and handle means rotatably attached to said other end of said channel member, said handle means having a channel therealong adapted to receive a portion of said hatchet blade when said hatchet blade is rotated into a folded position and having a catch mechanism to fixedly locate said handle means in an extended position from said channel member.

5. The folding hatchet described in claim 4 wherein said channel member further has a slot therethrough located in a position to engage said extension arm of said sliding bolt as said hatchet blade is rotated from said folded position toward said working position, said slot being shaped to progressively move said extension arm toward said one end of said slot to contain said bolt fully within said elongated hole, said slot having a shape which releases said extension arm to allow said bolt to engage said receptacle in said block member and lock said hatchet blade thereto when said hatchet blade is in said working position.

6. In a folding hand tool wherein a tool member is rotatably attached to a channel handle member, the improvement comprising;

a tool member having a working position and a folded position, said tool member having a receptacle therein adapted to receive a pin in sliding engagement therewith;

means attached to the channel handle member for receiving and engaging a pin;

a pin slidably mounted in said receptacle of said tool member, said pin having an extension arm mounted thereon at right angles thereto and extending from said receptacle in said tool member, said extension arm being adapted to engage a slot in a channel handle member, said pin engaging said means for receiving and engaging a pin when said tool member is rotated into said working position whereby locking said tool member in a fixed position with respect to the channel handle member, said pin disengaging said means for receiving and engaging a pin thereby unlocking said tool member from the channel handle member for rotating said tool member into said folded position;

bias means connected between said pin and said tool member to bias said pin into engagement with said means for receiving and engaging a pin; and a channel handle member having a slot therein located in a position to engage said extension arm of said pin as said tool member is rotated from said folded position to said working position, said slot having a shape which gradually forces said extension arm and said pin against said bias means to position said pin out of contact with said means for receiving and engaging a pin, said slot having a shape which releases said extension arm and said pin to engage said means for receiving and engaging a pin when said tool member is in said working position.

7. A channel member having a channel therealong and having two ends, one end being adapted to rotatably receive within said channel the blunt end of a hatchet blade and the other end being adapted to connect to a handle, said channel member having a slot therethrough adapted to engage the extension arm of a sliding bolt mounted in a hatchet blade to move the sliding bolt in a desired manner;

a hatchet blade having two oppositely disposed faces and a blunt end oppositely disposed from a cutting edge, said blunt end have a corner rotatably attached to said one end of said channel member such that said hatchet blade may be rotated into a folded position into said channel of said channel member and may be rotated into a working position with said blunt end located in said channel of said channel member, said hatchet blade having an elongated hole therein parallel to and centrally located between said oppositely disposed faces adjacent said blunt end and having an elongated opening in one of said faces which opening has two ends and is aligned with said elongated hole and connects a portion of said elongated hole with said one of said faces;

a sliding bolt mounted in said elongated hole in said hatchet blade and having an extension arm connected thereto which extends through said opening in said hatchet blade and outward from said one of said faces, said sliding bolt being slidable in said elongated hole and said extension arm being slidable in said opening such that when said extension arm is substantially at one end of said opening, said bolt is contained fully within said elongated hole and when said extension arm is substantially at the other end of said opening, said bolt extends from said elongated hole, said extension arm engaging said slot in said channel member as said hatchet blade is rotated from said folded position towards said working position, said slot in said channel member being shaped to progressively move said extension arm towards said one end of said opening in said hatchet blade to contain said bolt fully within said elongated hole, said slot in said channel member having a shape which releases said extension arm to allow said bolt to engage a receptacle in a block member and locks said hatchet blade thereto when said hatchet blade is in said working position;

bias means connected between said bolt and said hatchet blade for biasing said bolt into a projecting position to engage a receptacle in a block member;

a block member attached to said channel member, said block member having a receptacle therein positioned opposite said elongated hole in said hatchet blade when said hatchet blade is rotated into said working position whereby said bolt is biased to engaged said receptacle and lock said hatchet blade in said working position; and handle means rotatably attached to said other end of said channel member, said handle means having a channel therealong adapted to receive a portion of said hatchet blade when said hatchet blade is rotated into a folded position and having a catch mechanism to fixedly locate said handle means in an extended position from said channel member.

* * * * *